US012742549B2

(12) United States Patent
Magina et al.

(10) Patent No.: US 12,742,549 B2
(45) Date of Patent: Sep. 22, 2026

(54) TURBINE ENGINE COMBUSTOR HAVING A TUNABLE ACOUSTIC DAMPER

(71) Applicant: General Electric Company, Schenectady, NY (US)

(72) Inventors: Nicholas Arthur Magina, Saratoga Springs, NY (US); Fei Han, Clifton Park, NY (US); Bassam Sabry Mohammad Abdelnabi, West Chester, OH (US); Ramal Janith Samarasinghe, Albany, NY (US); Sibtosh Pal, Mason, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/653,215

(22) Filed: May 2, 2024

(65) Prior Publication Data

US 2025/0341310 A1 Nov. 6, 2025

(51) Int. Cl.
*F23R 3/00* (2006.01)

(52) U.S. Cl.
CPC .... *F23R 3/002* (2013.01); *F23R 2900/00013* (2013.01)

(58) Field of Classification Search
CPC ... F05D 2260/963; F23M 20/005; F23R 3/22; F23R 3/002; F23R 2900/00013
See application file for complete search history.

(56) References Cited

U.S. PATENT DOCUMENTS

| | | | |
|---|---|---|---|
| 6,205,765 | B1 | 3/2001 | Iasillo et al. |
| 6,464,489 | B1 | 10/2002 | Gutmark et al. |
| 6,634,457 | B2 | 10/2003 | Paschereit et al. |
| 6,820,431 | B2 | 11/2004 | McManus et al. |
| 7,337,877 | B2 | 3/2008 | Goenka et al. |
| 8,322,140 | B2 | 12/2012 | Kim et al. |
| 10,100,688 | B2 | 10/2018 | Imfeld et al. |
| 10,167,780 | B2 | 1/2019 | Joshi et al. |
| 10,539,156 | B2 * | 1/2020 | Marchaj ..... F02K 3/06 |
| 10,590,797 | B2 | 3/2020 | Abu-Irshaid et al. |
| 11,092,078 | B2 | 8/2021 | Joshi et al. |
| 11,326,780 | B2 | 5/2022 | Fujimoto et al. |
| 11,514,878 | B2 | 11/2022 | Semperlotti et al. |

(Continued)

FOREIGN PATENT DOCUMENTS

| | | | |
|---|---|---|---|
| DE | 19640980 | B4 | 6/2008 |
| DE | 102005062284 | B4 | 2/2019 |

(Continued)

*Primary Examiner* — Rodolphe Andre Chabreyrie
(74) *Attorney, Agent, or Firm* — Venable LLP; Michele V. Frank

(57) ABSTRACT

A combustor for a turbine engine includes a wall defining a combustion chamber, and an acoustic damper. The acoustic damper includes a housing in fluid communication with the combustion chamber through an opening provided in the wall, the housing defining a cavity and having one or more neck holes in fluid communication with the combustion chamber, and a mechanism configured to vary a damping acoustic frequency of the acoustic damper so as to vary the damping acoustic frequency of the acoustic damper to align with an acoustic frequency of acoustic vibrations generated in the combustion chamber to attenuate an acoustic instability within the combustion chamber.

6 Claims, 8 Drawing Sheets

(56) References Cited

U.S. PATENT DOCUMENTS

| | | | | |
|---|---|---|---|---|
| 11,525,396 | B2 * | 12/2022 | Bulat | F23M 20/005 |
| 12,134,986 | B1 * | 11/2024 | Nath | F02C 7/24 |
| 2002/0000343 | A1 | 1/2002 | Paschereit et al. | |
| 2002/0100281 | A1 * | 8/2002 | Hellat | F23M 20/005 60/725 |
| 2008/0216481 | A1 | 9/2008 | Pollarolo | |
| 2008/0308061 | A1 | 12/2008 | Yokota | |
| 2010/0212999 | A1 | 8/2010 | Marion et al. | |
| 2011/0139541 | A1 | 6/2011 | Schuermans et al. | |
| 2012/0228050 | A1 * | 9/2012 | Bulat | F23R 3/00 181/213 |
| 2014/0278200 | A1 * | 9/2014 | DeSilva | G01K 11/26 702/130 |
| 2015/0096829 | A1 * | 4/2015 | Bothien | F23R 3/16 181/204 |
| 2016/0003162 | A1 | 1/2016 | Beck et al. | |
| 2017/0176009 | A1 | 6/2017 | Szwedowicz et al. | |
| 2018/0174566 | A1 | 6/2018 | Copley et al. | |
| 2020/0202831 | A1 | 6/2020 | Lee et al. | |
| 2022/0282870 | A1 | 9/2022 | Kim et al. | |
| 2022/0349346 | A1 | 11/2022 | Shiraishi et al. | |
| 2023/0175440 | A1 | 6/2023 | Winkler et al. | |
| 2023/0175692 | A1 | 6/2023 | Kostrzewa et al. | |
| 2023/0184366 | A1 | 6/2023 | Hansmann et al. | |

FOREIGN PATENT DOCUMENTS

| | | | |
|---|---|---|---|
| EP | 2383514 | A1 | 11/2011 |
| EP | 2642204 | A1 | 9/2013 |
| EP | 2667096 | A2 | 11/2013 |
| GB | 2288660 | A | 10/1995 |
| WO | 2010149420 | A1 | 12/2010 |
| WO | 2018099802 | A1 | 6/2018 |

* cited by examiner

TURBINE ENGINE COMBUSTOR HAVING A TUNABLE ACOUSTIC DAMPER

TECHNICAL FIELD

The present disclosure relates generally to a turbine engine combustor having a tunable acoustic damper.

BACKGROUND

Turbine engines, for example, for aircraft, generally include a fan and a turbo-engine section arranged in flow communication with one another. The turbo-engine section includes a combustion section. The combustion section includes a combustor. An acoustic damper can be used to reduce or to suppress combustion instability in the combustor by reducing acoustic vibrations within the combustor.

BRIEF DESCRIPTION OF THE DRAWINGS

Features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
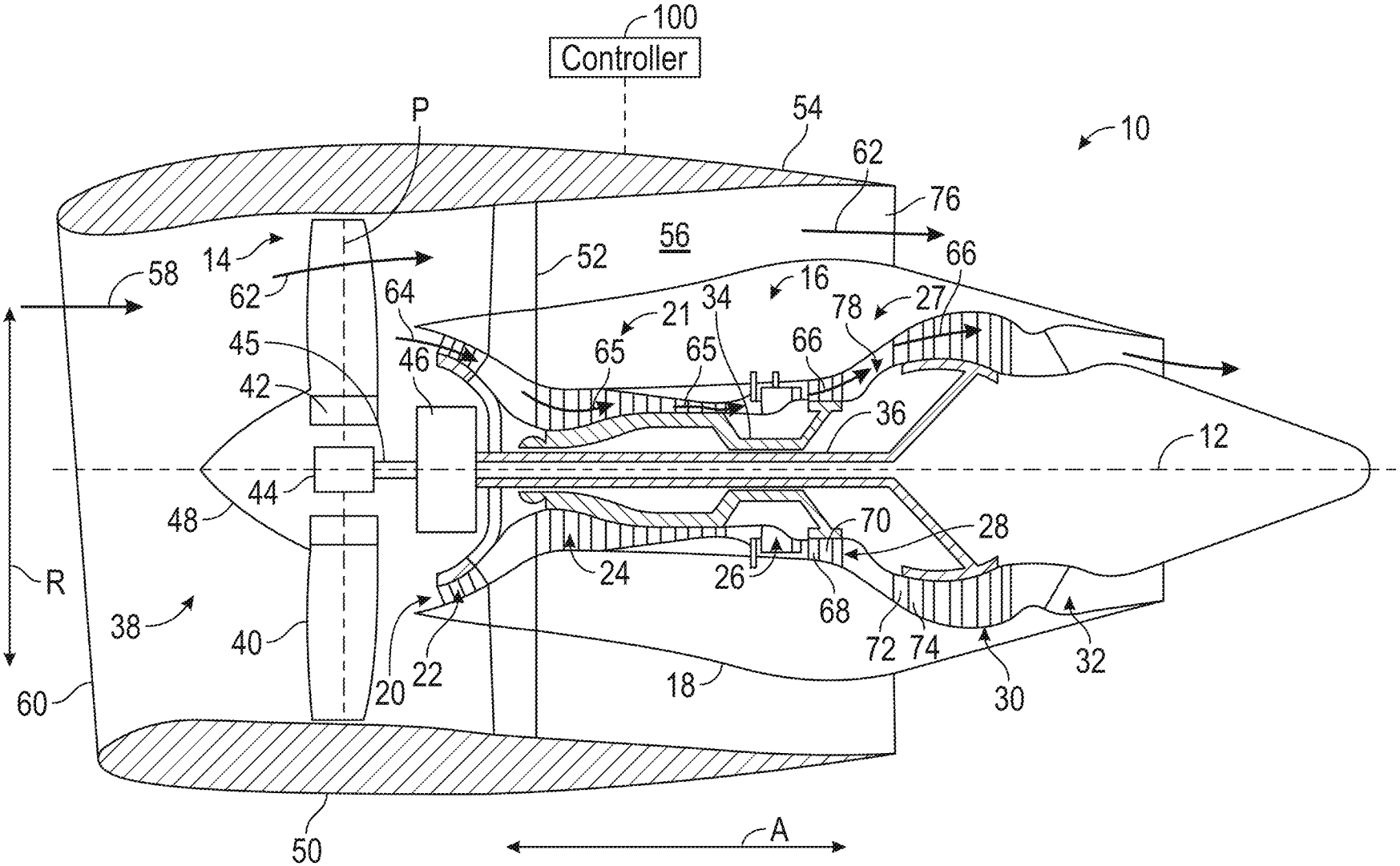
FIG. 1 is a schematic cross-sectional view of a turbine engine, taken along a centerline axis of the turbine engine, according to the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the present disclosure.

As used herein, the terms "first" and "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle. For example, with regard to a turbine engine, forward refers to a position on the turbine engine that is closer to the propeller or the fan and aft refers to a position on the turbine engine that is further away from the propeller or the fan.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

As used herein, "top" refers to a highest or an uppermost point, portion, or surface of a component in the orientations shown in the figures.

As used herein, "bottom" refers to a lowest or a lowermost point, portion, or surface of a component in the orientations shown in the figures.

As used herein, the terms "low," "mid" (or "mid-level"), and "high," or their respective comparative degrees (e.g., "lower" and "higher", where applicable), when used with compressor, combustor, turbine, shaft, fan, or turbine engine components, each refers to relative pressures, relative speeds, relative temperatures, or relative power outputs within an engine unless otherwise specified. For example, a "low-power" setting defines the engine or the combustor configured to operate at a power output lower than a "high-power" setting of the engine or the combustor, and a "mid-level power" setting defines the engine or the combustor configured to operate at a power output higher than a "low-power" setting and lower than a "high-power" setting. The terms "low," "mid" (or "mid-level"), or "high" in such terms may additionally, or alternatively, be understood as being relative to minimum allowable speeds, pressures, or temperatures, or minimum or maximum allowable speeds, pressures, or temperatures relative to normal, desired, steady state, etc., operation of the engine. A mission cycle for a turbine engine includes, for example, a low-power operation, a mid-level power operation, and a high-power operation. Low-power operation includes, for example, engine start, idle, taxiing, and approach. Mid-level power operation includes, for example, cruise. High-power operation includes, for example, takeoff and climb.

The various power levels of the turbofan engine are defined as a percentage of a sea level static (SLS) maximum engine rated thrust. Low power operation includes, for example, less than thirty percent (30%) of the SLS maximum engine rated thrust of the turbofan engine. Mid-level power operation includes, for example, thirty percent (30%) to eighty-five percent (85%) of the SLS maximum engine rated thrust of the turbofan engine. High power operation includes, for example, greater than eighty-five percent (85%) of the SLS maximum engine rated thrust of the turbofan engine. The values of the thrust for each of the low power operation, the mid-level power operation, and the high power operation of the turbofan engine are exemplary only, and other values of the thrust can be used to define the low power operation, the mid-level power operation, and the high power operation.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

As used herein, a "turbo-engine" includes a compressor section, a combustion section, and a turbine section.

As used herein, a "turbofan engine" includes a turbo-engine and a fan that directs air into the turbo-engine, and rated for use in a regional aircraft, a narrow body aircraft, or a wide body aircraft. A turbofan engine rated for use on a regional aircraft will have a maximum takeoff thrust in a range of ten thousand pound-force to twenty thousand pound-force (10,000 lbf to 20,000 lbf). A turbofan engine rated for use on a narrow body aircraft will have a maximum takeoff thrust in a range of fifteen thousand pound-force to thirty thousand pound-force (15,000 lbf to 30,000 lbf). A turbofan engine rated for use on a wide body aircraft will have a maximum takeoff thrust in a range of forty thousand pound-force to one hundred ten thousand pound-force (40,000 lbf to 110,000 lbf).

As used herein, the term "ducted engine" means a turbofan engine with a fan casing or a nacelle that circumferentially surrounds the fan.

As used herein, an "unducted fan engine" or an "open fan engine" means a turbofan engine without a fan casing or a nacelle surrounding the fan.

Hereafter, the term "turbofan engine" will refer to either a "ducted engine" or an "open fan engine."

As used herein, a Mach number is a ratio of the speed of the turbofan engine (of the aircraft) to the speed of sound in the surrounding airflow.

Approximating language, as used herein throughout the specification and claims, is applied to modify any quantitative representation that could permissibly vary without resulting in a change in the basic function to which it is related. Accordingly, a value modified by a term or terms, such as "about," "approximately," "generally," and "substantially" is not to be limited to the precise value specified. In at least some instances, the approximating language may correspond to the precision of an instrument for measuring the value, or the precision of the methods or the machines for constructing the components and/or the systems or manufacturing the components and/or the systems. For example, the approximating language may refer to being within a one, two, four, ten, fifteen, or twenty percent margin in either individual values, range(s) of values and/or endpoints defining range(s) of values.

In an aircraft gas turbine engine, a combustor may generally include a swirler that provides a flow of swirled air mixed with fuel into a combustion chamber, where the fuel and air mixture is ignited and burned. The burning of the fuel and air mixture in the combustion chamber results in generating acoustic vibrations (e.g., a thermo-acoustic wave) that may lead to a combustion instability within the combustor.

An acoustic damper can be used to reduce or to suppress the combustion instability in a combustor of a turbine engine by reducing the amplitude of acoustic vibrations within the combustor. The acoustic damper can have its performance optimized in real time by enabling the acoustic damper to be thermodynamically adaptively tunable. The acoustic damper can be adaptively tunable or manually tunable. Initial incorrect assumptions about acoustic frequencies in a combustor can be made during the design process of the acoustic damper. The acoustic damper frequency can be designed to align with an assumed frequency of an acoustic instability of the combustor. However, during operation or in certain environmental conditions, the frequency of the acoustic instability of the combustor can shift relative to the assumed frequency of the acoustic instability of the combustor. As a result, the acoustic damper can be mistuned and may not be aligned with the measured frequency of the acoustic instability of the combustor. By providing an acoustic damper that is tunable in acoustic frequency, the problem of having initial incorrect assumptions made during the design process of the acoustic damper can be corrected by tuning the acoustic damper to the measured frequency of the acoustic instability of the combustor.

According to aspects of the present disclosure, a single baseline acoustic damper can be manufactured, and the acoustic performance and targeted frequency can be tuned to the specific frequency of the acoustic instability measured in the combustor at any given time. The measured frequency of the acoustic instability of the combustor can also shift over the operational space and the frequency of maximum damping attenuation for the acoustic damper can also shift for a number of unexpected reasons. For example, the acoustic damper can be exposed to ambient conditions that vary with seasonal swings in temperature (e.g., summer and winter) as well as geographical location (e.g., north pole and equator). The acoustic damper can be tuned for maximum attenuation at the measured acoustic frequency of the acoustic instability in the combustor. In some embodiments, the acoustic damper can be modified using mechanical measures. Some examples of mechanical tuning include, but are not limited to, a piston that is movable to alter the volume of the cavity of the acoustic damper, a bellows system internally or at the end of the cavity of the acoustic damper that is configured to expand and to contract to alter the length of the cavity of the acoustic damper, adjustable orifices to alter neck diameters in the acoustic damper, or an adjustable neck length device in the acoustic damper. In other embodiments, the acoustic damper can be modified using thermodynamic measures to augment the acoustic performance of the acoustic damper so that the acoustic damper is tuned to the measured frequency of the acoustic instability in the combustor. Some examples of thermodynamic tuning include, but are not limited to, injecting unique mixtures of gases. In an embodiment, an acoustic damper having multiple gas chambers separated by an acoustically permeable membrane can be used. In another embodiment, internal gas temperatures can be intentionally modified to alter the speed of sound within a cavity of the acoustic damper. The speed of sound can also be altered by varying a volume or a temperature of air within the acoustic damper. The acoustic damper can be modified using a combination of any of the above mechanical measures and any of the above thermodynamic measures.

Referring now to the drawings, FIG. 1 is a schematic cross-sectional diagram of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference) and a radial direction R that is normal to the axial direction A. In general, the turbine engine 10 includes a fan section 14 and a turbo-engine 16 disposed downstream from the fan section 14.

The turbo-engine 16 includes, in serial flow relationship, a compressor section 21, a combustion section 26, and a turbine section 27. The turbo-engine 16 is substantially enclosed within an outer casing 18 that is substantially tubular and defines a turbo-engine inlet 20 that is annular about the longitudinal centerline axis 12. As schematically shown in FIG. 1, the compressor section 21 includes a booster or a low pressure (LP) compressor 22 followed downstream by a high pressure (HP) compressor 24. The combustion section 26 is downstream of the compressor section 21. The turbine section 27 is downstream of the combustion section 26 and includes a high pressure (HP) turbine 28 followed downstream by a low pressure (LP) turbine 30. The turbo-engine 16 further includes a jet exhaust nozzle section 32 that is downstream of the turbine section 27, a high-pressure (HP) shaft 34 or a spool, and a low-pressure (LP) shaft 36. The HP shaft 34 drivingly connects the HP turbine 28 to the HP compressor 24. The HP turbine 28 and the HP compressor 24 rotate in unison through the HP shaft 34. The LP shaft 36 drivingly connects the LP turbine 30 to the LP compressor 22. The LP turbine 30 and the LP compressor 22 rotate in unison through the LP shaft 36. The compressor section 21, the combustion section 26, the turbine section 27, and the jet exhaust nozzle section 32 together define a turbo-engine air flow path.

For the embodiment depicted in FIG. 1, the fan section 14 includes a fan 38 (e.g., a variable pitch fan) having a plurality of fan blades 40 coupled to a disk 42 in a spaced apart manner. As depicted in FIG. 1, the fan blades 40 extend outwardly from the disk 42 generally along the radial direction R. In the case of a variable pitch fan, the plurality of fan blades 40 are rotatable relative to the disk 42 about a pitch axis P by virtue of the fan blades 40 being operatively coupled to an actuation member 44 configured to collectively vary the pitch of the fan blades 40 in unison. The fan blades 40, the disk 42, and the actuation member 44 are together rotatable about the longitudinal centerline axis 12 via a fan shaft 45 that is powered by the LP shaft 36 across a power gearbox, also referred to as a gearbox assembly 46. In this way, the fan 38 is drivingly coupled to, and powered by, the turbo-engine 16, and the turbine engine 10 is an indirect drive engine. The gearbox assembly 46 is shown schematically in FIG. 1. The gearbox assembly 46 is a reduction gearbox assembly for adjusting the rotational speed of the fan shaft 45 and, thus, the fan 38 relative to the LP shaft 36 when power is transferred from the LP shaft 36 to the fan shaft 45.

Referring still to the exemplary embodiment of FIG. 1, the disk 42 is covered by a fan hub 48 that is aerodynamically contoured to promote an airflow through the plurality of fan blades 40. In addition, the fan section 14 includes an annular fan casing or a nacelle 50 that circumferentially surrounds the fan 38 and at least a portion of the turbo-engine 16. The nacelle 50 is supported relative to the turbo-engine 16 by a plurality of outlet guide vanes 52 that are circumferentially spaced about the nacelle 50 and the turbo-engine 16. Moreover, a downstream section 54 of the nacelle 50 extends over an outer portion of the turbo-engine 16, and, with the outer casing 18, defines a bypass airflow passage 56 therebetween.

During operation of the turbine engine 10, a volume of air 58 enters the turbine engine 10 through an inlet 60 of the nacelle 50 or the fan section 14. As the volume of air 58 passes across the fan blades 40, a first portion of air, also referred to as bypass air 62 is routed into the bypass airflow passage 56, and a second portion of air, also referred to as turbo-engine air 64, is routed into the upstream section of the turbo-engine air flow path through the turbo-engine inlet 20 of the LP compressor 22. The pressure of the turbo-engine air 64 is then increased, generating compressed air 65. The compressed air 65 is routed through the HP compressor 24 and into the combustion section 26, where the compressed air 65 is mixed with fuel and ignited to generate combustion gases 66.

The combustion gases 66 are routed into the HP turbine 28 and expanded through the HP turbine 28 where a portion of thermal energy or kinetic energy from the combustion gases 66 is extracted via one or more stages of HP turbine stator vanes 68 and HP turbine rotor blades 70 that are coupled to the HP shaft 34. This causes the HP shaft 34 to rotate, thereby supporting operation of the HP compressor 24 (self-sustaining cycle). In this way, the combustion gases 66 do work on the HP turbine 28. The combustion gases 66 are then routed into the LP turbine 30 and expanded through the LP turbine 30. Here, a second portion of the thermal energy or the kinetic energy is extracted from the combustion gases 66 via one or more stages of LP turbine stator vanes 72 and LP turbine rotor blades 74 that are coupled to the LP shaft 36. This causes the LP shaft 36 to rotate, thereby supporting operation of the LP compressor 22 (self-sustaining cycle) and rotation of the fan 38 via the gearbox assembly 46. In this way, the combustion gases 66 do work on the LP turbine 30.

The combustion gases 66 are subsequently routed through the jet exhaust nozzle section 32 of the turbo-engine 16 to provide propulsive thrust. Simultaneously, the bypass air 62 is routed through the bypass airflow passage 56 before being exhausted from a fan nozzle exhaust section 76 of the turbine engine 10, also providing propulsive thrust. The HP turbine 28, the LP turbine 30, and the jet exhaust nozzle section 32 at least partially define a hot gas path 78 for routing the combustion gases 66 through the turbo-engine 16.

A controller 100 is in communication with the turbine engine 10 for controlling aspects of the turbine engine 10. For example, the controller 100 is in two-way communication with the turbine engine 10 for receiving signals from various sensors and control systems of the turbine engine 10 and for controlling components of the turbine engine 10, as detailed further below. The controller 100, or components thereof, may be located onboard the turbine engine 10, onboard the aircraft, or can be located remote from each of the turbine engine 10 and the aircraft. The controller 100 can be a Full Authority Digital Engine Control (FADEC) that controls aspects of the turbine engine 10.

The controller 100 may be a standalone controller or may be part of an engine controller to operate various systems of the turbine engine 10. In this embodiment, the controller 100 is a computing device having one or more processors and a memory. The one or more processors can be any suitable processing device, including, but not limited to, a microprocessor, a microcontroller, an integrated circuit, a logic device, a programmable logic controller (PLC), an application specific integrated circuit (ASIC), or a Field Programmable Gate Array (FPGA). The memory can include one or more computer-readable media, including, but not limited to, non-transitory computer-readable media, a computer readable non-volatile medium (e.g., a flash memory), a RAM, a ROM, hard drives, flash drives, or other memory devices.

The memory can store information accessible by the one or more processors, including computer-readable instructions that can be executed by the one or more processors. The instructions can be any set of instructions or a sequence of instructions that, when executed by the one or more processors, cause the one or more processors and the controller 100 to perform operations. The controller 100 and, more specifically, the one or more processors are programmed or configured to perform these operations, such as the operations discussed further below. In some embodiments, the instructions can be executed by the one or more processors to cause the one or more processors to complete any of the operations and functions for which the controller 100 is configured, as will be described further below. The instructions can be software written in any suitable programming language or can be implemented in hardware. Additionally, or alternatively, the instructions can be executed in logically or virtually separate threads on the processors. The memory can further store data that can be accessed by the one or more processors.

The technology discussed herein makes reference to computer-based systems and actions taken by, and information sent to and from, computer-based systems. One of ordinary skill in the art will recognize that the inherent flexibility of computer-based systems allows for a great variety of possible configurations, combinations, and divisions of tasks and functionality between and among components. For instance, processes discussed herein can be implemented using a single computing device or multiple computing devices working in combination. Databases, memory, instructions, and applications can be implemented on a single system or distributed across multiple systems. Distributed components can operate sequentially or in parallel.

The turbine engine 10 depicted in FIG. 1 is by way of example only. In other exemplary embodiments, the turbine engine 10 may have any other suitable configuration. For example, in other exemplary embodiments, the fan 38 may be configured in any other suitable manner (e.g., as a fixed pitch fan) and further may be supported using any other suitable fan frame configuration. The turbine engine 10 may also be a direct drive engine, which does not have a power gearbox. The fan speed is the same as the LP shaft speed for a direct drive engine. Moreover, in other exemplary embodiments, any other suitable number or configuration of compressors, turbines, shafts, or a combination thereof may be provided. In still other exemplary embodiments, aspects of the present disclosure may be incorporated into any other suitable turbine engine, such as, for example, turbofan engines, propfan engines, turbojet engines, turboprop, turboshaft engines, or aeroderivative ground based engines.

Figure 2:
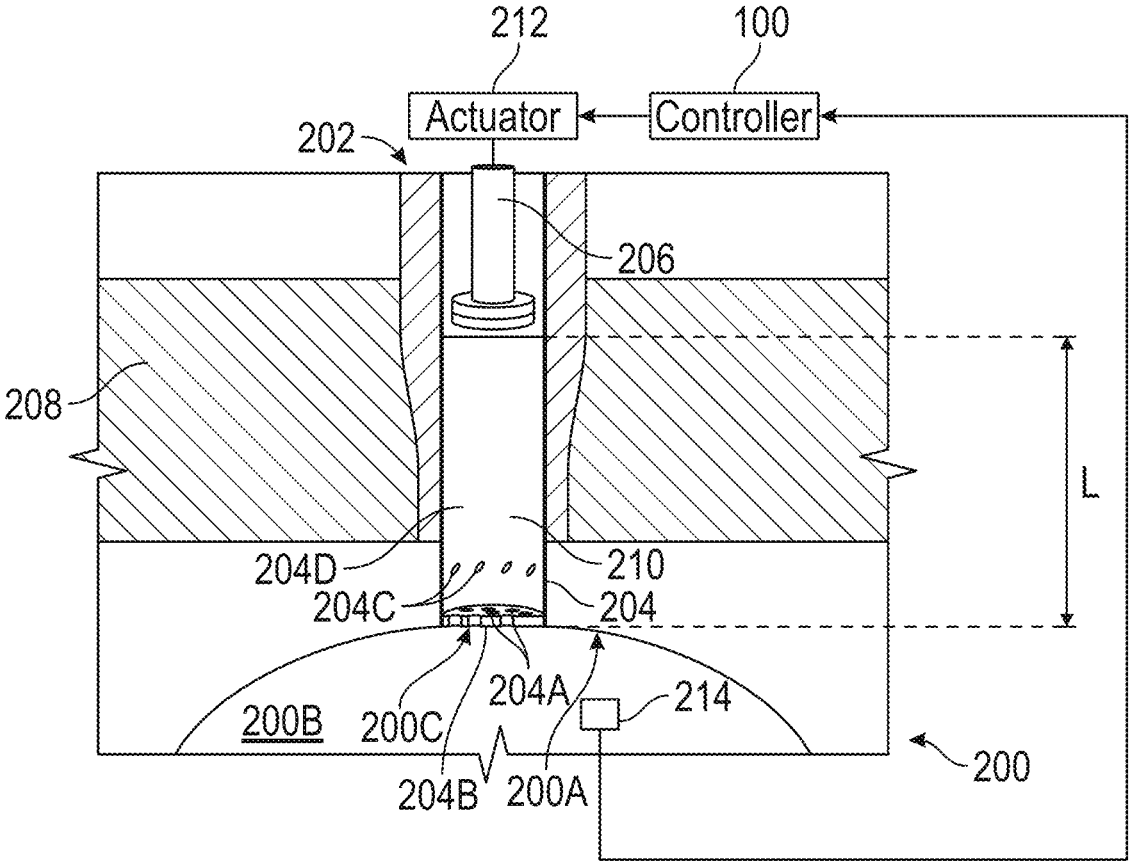
FIG. 2 is a schematic cross-sectional view of an acoustic damper in a combustor of a turbine engine, the acoustic damper having a piston, according to an embodiment of the present disclosure.

FIG. 2 is a schematic diagram of an acoustic damper in a combustor of a turbine engine, the acoustic damper having a piston, according to an embodiment of the present disclosure. As shown in FIG. 2, a combustor 200 is provided with an acoustic damper 202. The acoustic damper 202 includes a housing 204 connected to a wall 200A of the combustor 200. The wall 200A defines a combustion chamber 200B where fuel and air are mixed, and the fuel and air mixture is ignited and burned. The housing 204 of the acoustic damper 202 is in fluid communication with the combustion chamber 200B through an opening 200C provided within the wall 200A. The housing 204 of the acoustic damper 202 is mounted to the combustor 200 via an armature 208. In an embodiment, as shown in FIG. 2, the housing 204 has generally a cylindrical shape with a circular base. In other embodiments, the housing 204 can have any shape, such as, but not limited to, a cylindrical shape with a polygonal base or an elliptical base.

The housing 204 of the acoustic damper 202 has one or more neck holes 204A provided at an end of the housing 204. The one or more neck holes 204A are in fluid communication with the combustion chamber 200B. The one or more neck holes 204A are provided within a face plate 204B of the housing 204 facing the combustion chamber 200B. The housing 204 of the acoustic damper 202 may also be provided with one or more purge holes 204C. The one or more purge holes 204C are provided within a lateral wall 204D of the housing 204.

In an embodiment, the acoustic damper 202 may include a piston 206 provided within the housing 204. The piston 206 is configured to vary a volume of a cavity 210 within the housing 204. The piston 206 is configured to mechanically adjust a length L of the housing 204 and, thus, vary a volume of the cavity 210 within the housing 204 of the acoustic damper 202. By varying or adjusting the length L of the housing 204 of the acoustic damper 202, a damping acoustic frequency of the acoustic damper 202 can be varied or tuned to coincide with a measured acoustic frequency of the combustion within the combustion chamber 200B of the combustor 200.

The burning of the fuel and air mixture in the combustion chamber 200B results in generating acoustic vibrations (e.g., a thermo-acoustic wave) that may lead to combustion instability within the combustor 200. The acoustic damper 202 can be used to reduce or to suppress the combustion instability in the combustor 200 by reducing the amplitude of acoustic vibrations within the combustor 200. The acoustic damper 202 can have its performance optimized in real time by enabling the acoustic damper 202 to be thermodynamically adaptively tunable so as to substantially match the damping frequency of the acoustic damper 202 with the measured acoustic frequency generated by the combustion in the combustion chamber 200B of the combustor 200.

The combustor 200 includes a mechanism configured to vary a damping acoustic frequency of the acoustic damper 202 so as to vary the damping acoustic frequency of the acoustic damper 202 to align with an acoustic frequency of acoustic vibrations generated in the combustion chamber 200B to attenuate an acoustic instability within the combustion chamber 200B. In an embodiment, as shown in FIG. 2, the mechanism includes the piston 206 configured to move within the cavity 210 of the housing 204 to vary a length of the cavity 210 so as to vary the damping acoustic frequency of the acoustic damper 202.

Figure 3:
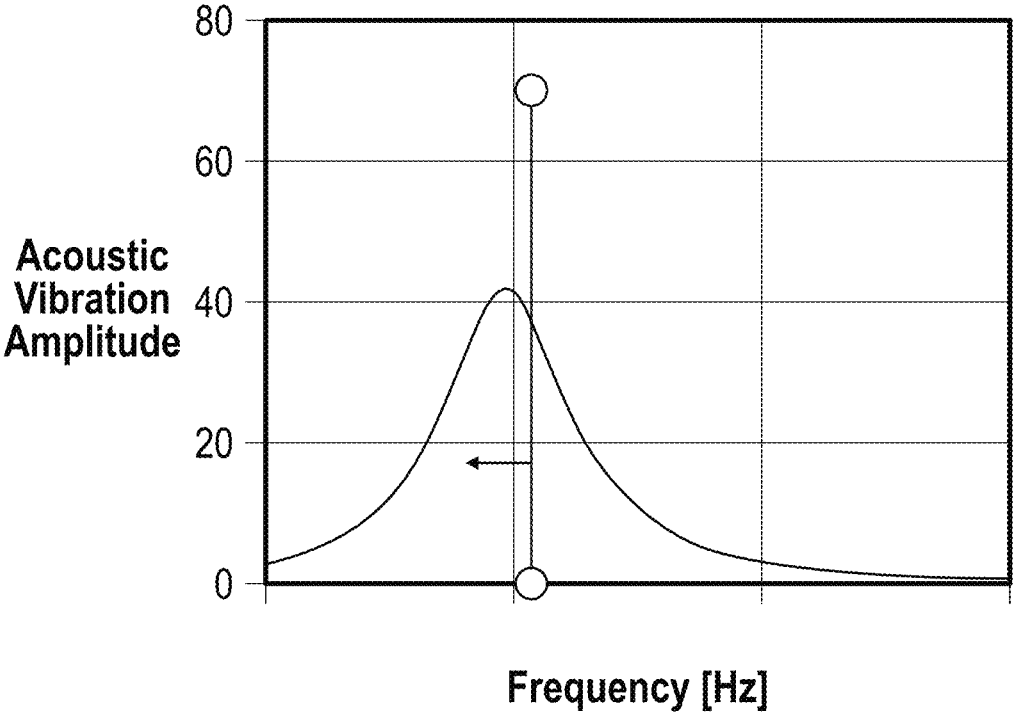
FIG. 3 is a plot of an acoustic vibration amplitude versus an acoustic frequency, according to an embodiment of the present disclosure.

FIG. 3 is a plot of an acoustic vibration amplitude versus an acoustic frequency, according to an embodiment of the present disclosure. The Gaussian-like curve or bell curve in FIG. 3 represents the acoustic amplitude that is absorbed or attenuated by the acoustic damper 202 of FIG. 2. The vertical line in FIG. 3 represents a location of a measured acoustic frequency of the combustion within the combustion chamber 200B. The measured acoustic frequency of the combustion within the combustion chamber 200B can vary in frequency depending on outside environment (hot, cold, etc.), the air and fuel mixture, and the temperature of the combustion, and may not coincide with a peak of the Gaussian-like curve or the bell curve in FIG. 3 representing the acoustic amplitude that is absorbed or attenuated by the acoustic damper 202.

Initial incorrect assumptions about acoustic frequencies of the combustion within the combustion chamber 200B of the combustor 200 can be made during the design process of the acoustic damper 202. Initially, the acoustic damping frequency can be designed to align with an assumed frequency of an acoustic instability of the combustor. However, during operation or in certain environmental conditions, the acoustic frequency of the acoustic instability of the combustion within the combustion chamber 200B can shift relative to the assumed frequency of the acoustic instability of the combustion within the combustion chamber 200B, for example, as shown in FIG. 3. As a result, the acoustic damper 202 can be mistuned and the damping acoustic frequency of the acoustic damper may not be aligned with the measured acoustic frequency of the acoustic instability within the combustion chamber 200B, as shown in FIG. 3. By providing an acoustic damper 202 that is tunable in acoustic frequency, the problem of having initial incorrect assumptions made during the design process of the acoustic damper 202 can be corrected by tuning the acoustic damper 202 to the measured acoustic frequency of the acoustic instability of the combustor 200. For example, this can be accomplished by varying a length L and, thus, a volume of the cavity 210 within the housing 204 of the acoustic damper 202. With respect to the plot shown in FIG. 3, a goal is to bring the bell curve or the Gaussian-like curve corresponding to the acoustic amplitude that can be absorbed or attenuated by the acoustic damper 202 approximately centered in acoustic frequency around the vertical line corresponding to the measured acoustic frequency of the combustion instability within the combustion chamber 200B to absorb or to attenuate the amplitude of the combustion instability within the combustion chamber 200B.

An acoustic frequency is inversely proportional to a volume and, thus, to a length of a cavity. Therefore, by increasing or decreasing the length L of the cavity 210 within the housing 204 the damping acoustic frequency of the acoustic damper 202 can be tuned (i.e., decreased or increased, respectively).

The measured frequency of the acoustic instability of the combustor 200 can shift over the operational space and the frequency of maximum damping attenuation for the acoustic damper 202 can also shift for a number of unexpected reasons. For example, the acoustic damper 202 can be exposed to ambient conditions that vary with seasonal swings in temperature (e.g., summer and winter) as well as geographical location (e.g., north pole and equator). The acoustic damper 202 can be tuned for maximum attenuation at the measured acoustic frequency to attenuate the acoustic instability within the combustion chamber 200B in the combustor 200.

Returning to FIG. 2, in an embodiment, the tuning can be performed manually by a user. For example, after measuring the frequency of the acoustic vibration of the combustion within the combustion chamber 200B, the user can send a control signal to an actuator 212 via the controller 100 to move the piston 206 to vary the length of the L of the cavity 210 of the housing 204 of the acoustic damper 202. In another embodiment, the tuning can be performed automatically using a feedback loop. For example, a sensor 214 can be used to measure the frequency of the acoustic vibration of the combustion within the combustion chamber 200B. The sensor 214 is in communication with the controller 100 and is configured to send a measurement signal to the controller 100. The controller 100 is in communication with the actuator 212 and is configured to send a control signal to the actuator 212, based on the measurement signal, to move the piston 206 to vary the length of the L of the cavity 210 of the housing 204 of the acoustic damper 202. In this configuration, the tuning is accomplished automatically without the intervention of the user.

Figure 4:
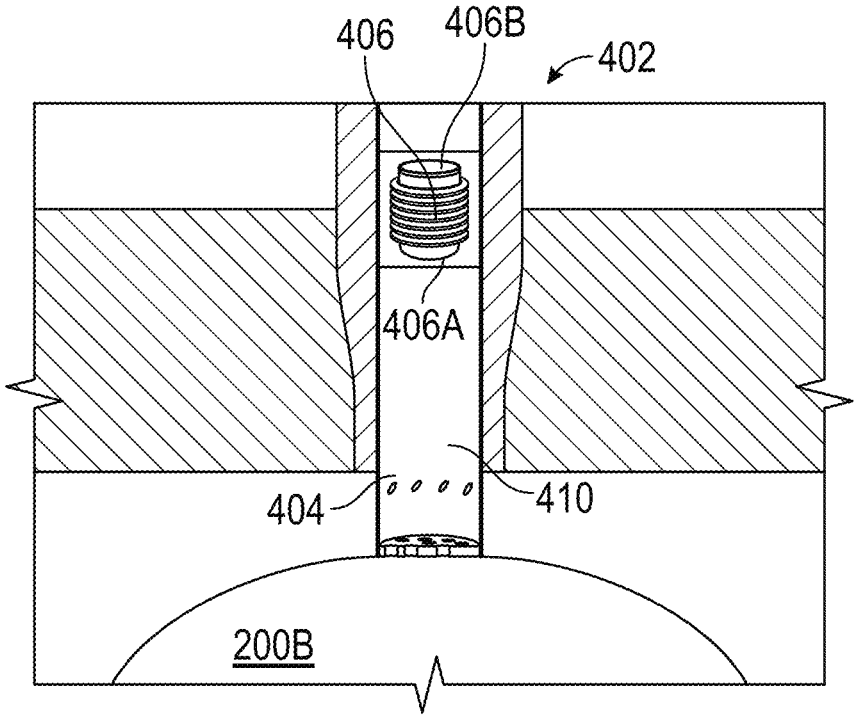
FIG. 4 is a schematic cross-sectional view of an acoustic damper in a combustor of a turbine engine, the acoustic damper having a bellows, according to another embodiment of the present disclosure.

FIG. 4 is a schematic cross-sectional view of an acoustic damper in a combustor of a turbine engine, the acoustic damper having a bellows, according to another embodiment of the present disclosure. Acoustic damper 402 is similar in many aspects to acoustic damper 202 (FIG. 2). Therefore, similar features in acoustic damper 402 are not further described. For example, similar to the acoustic damper 202 having the housing 204 (FIG. 2), the acoustic damper 402 has a housing 404. One distinction between the acoustic damper 402 and the acoustic damper 202 is that, instead of providing a piston 206 (FIG. 2) in the acoustic damper 202, the acoustic damper 402 is provided with bellows 406. The bellows 406 are provided within the housing 404 of the acoustic damper 402. Similar to the piston 206 in the acoustic damper 202, the bellows 406 is movable to vary a volume of a cavity 410 within the housing 404. In an embodiment, the bellows 406 has an end surface 406A that is closed and is movable relative to an opposite end surface 406B. Therefore, in an embodiment, the volume of the cavity 410 inside the housing 404 can be varied by varying a length of the bellows 406. In another embodiment, the bellows 406 has the end surface 406A that is open and is movable relative to an opposite end surface 406B. In this case, a volume inside the bellows 406 can also be varied due to a variation of a total length of the acoustic damper 402. By varying a volume of the cavity 410 within the housing 404, the damping acoustic frequency of the acoustic damper 402 can be varied as needed to match the acoustic frequency within the combustion chamber 200B.

In this embodiment, the combustor 200 includes a mechanism configured to vary a damping acoustic frequency of the acoustic damper 402 so as to vary the damping acoustic frequency of the acoustic damper 402 to align with an acoustic frequency of acoustic vibrations generated in the combustion chamber 200B to attenuate an acoustic instability within the combustion chamber 200B. In this embodiment, as shown in FIG. 4, the mechanism includes the bellows 406 configured to move within the cavity 410 of the housing 404 to vary a length of the cavity 410 so as to vary the damping acoustic frequency of the acoustic damper 402.

Figure 5:
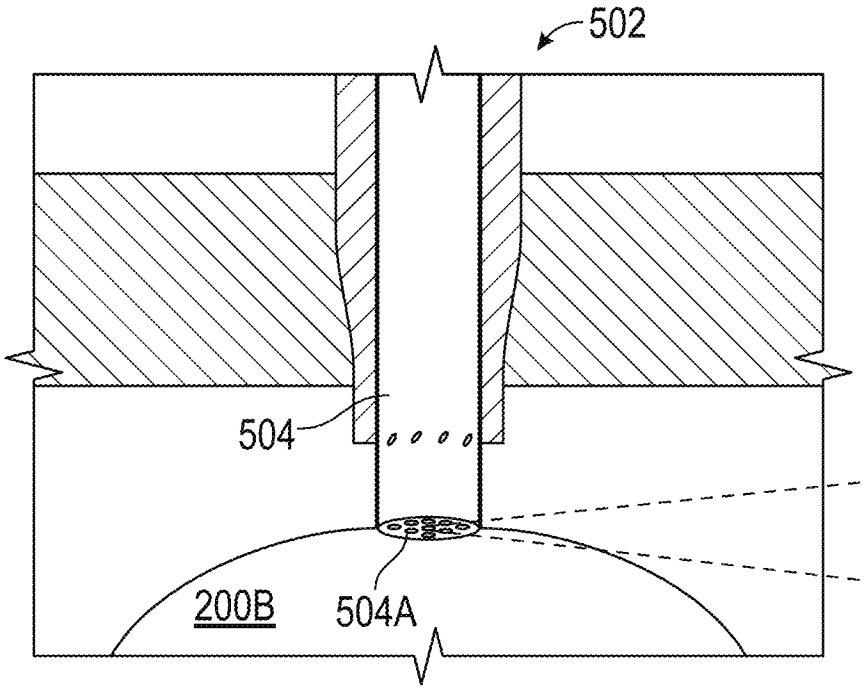
FIG. 5 is a schematic cross-sectional view of an acoustic damper in a combustor of a turbine engine, the acoustic damper having one or more adjustable neck holes, according to another embodiment of the present disclosure.

FIG. 5 is a schematic cross-sectional view of an acoustic damper in a combustor of a turbine engine, the acoustic damper having one or more adjustable neck holes, according to another embodiment of the present disclosure. Acoustic damper 502 is similar in many aspects to acoustic damper 202 (FIG. 2). Therefore, similar features in acoustic damper 402 are not further described. For example, similar to the acoustic damper 202 having the housing 204 (FIG. 2), the acoustic damper 502 has a housing 504. One distinction between the acoustic damper 502 and the acoustic damper 202 is that the acoustic damper 502 is not provided with a piston 206 (shown in FIG. 2) or the bellows 406 (shown in FIG. 4). Instead, the housing 504 includes one or more neck holes 504A that are adjustable (e.g., have an adjustable diameter). For example, the one or more neck holes 504A are adjustable using one or more shutters 505A, as shown in FIG. 6.

In this embodiment, the combustor 200 includes a mechanism configured to vary a damping acoustic frequency of the acoustic damper 502 so as to vary the damping acoustic frequency of the acoustic damper 502 to align with an acoustic frequency of acoustic vibrations generated in the combustion chamber 200B to attenuate an acoustic instability within the combustion chamber 200B. In this embodiment, the mechanism includes the one or more shutters 505A configured to vary a dimension of the one or more neck holes 504A to vary the damping acoustic frequency of the acoustic damper 202. The one or more shutters 505A can be provided on a portion of the one or more neck holes 504A. The one or more shutters 505A can be rotatable shutters, slidable shutters, and/or iris-type shutters.

Figure 6:
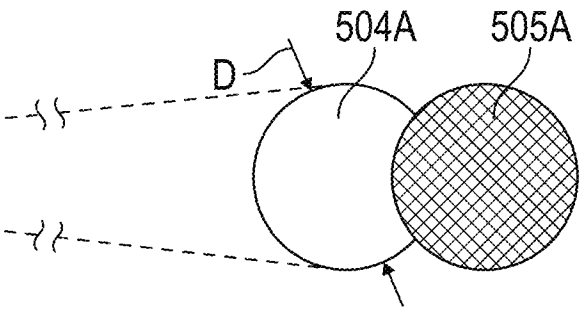
FIG. 6 is a schematic diagram of an example shutter for adjusting a dimension of the one or more neck holes, according to an embodiment of the present disclosure.

FIG. 6 is a schematic diagram of an example shutter for adjusting a dimension of the one or more neck holes 504A, according to an embodiment of the present disclosure. The one or more shutters 505A can, for example, be provided on a portion of the one or more neck holes 504A. The one or more shutters 505A can be sliding shutters, a rotatable or hinged shutters, or iris-type shutters, etc. The one or more shutters 505A allow for the adjustment of a diameter D of the one or more neck holes 504A. By adjusting the one or more shutters 505A of the one or more neck holes 504A, a damping acoustic frequency of the acoustic damper 502 (FIG. 5) can be adjusted as needed to match the acoustic frequency within the combustion chamber 200B (FIG. 5).

Figure 7:
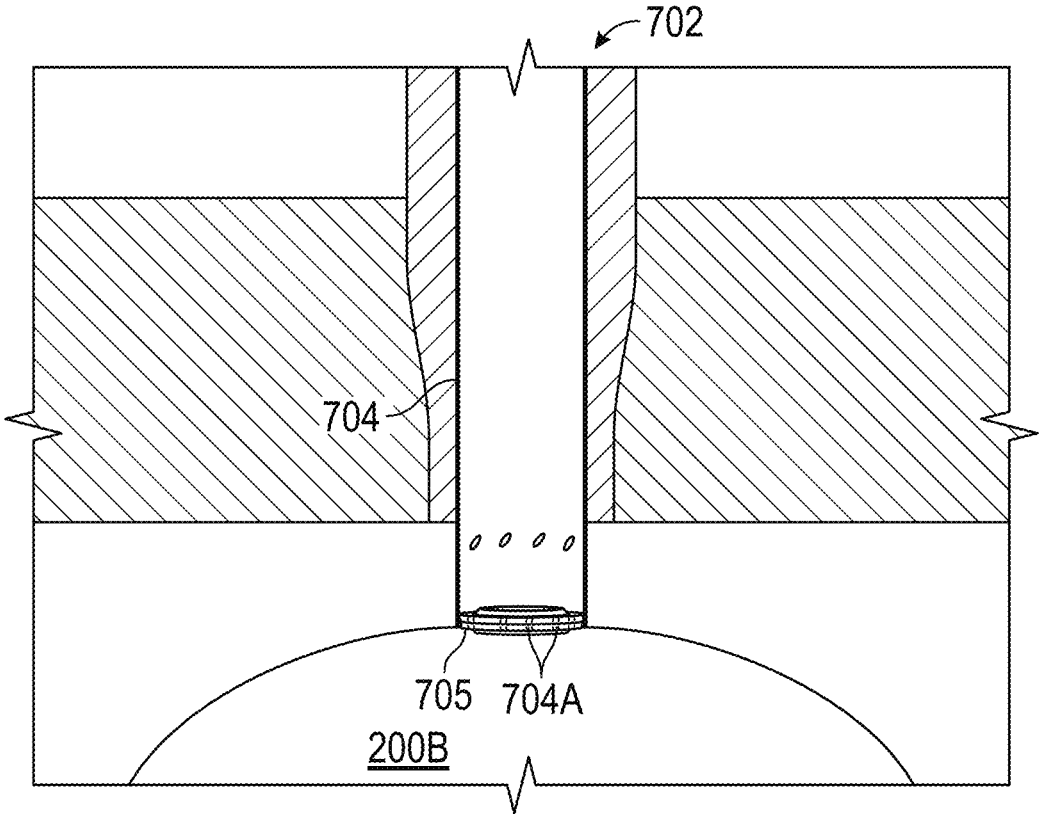
FIG. 7 is a schematic cross-sectional view of an acoustic damper in a combustor of a turbine engine, the acoustic damper having one or more adjustable neck length, according to another embodiment of the present disclosure.

FIG. 7 is a schematic cross-sectional view of an acoustic damper in a combustor of a turbine engine, the acoustic damper having one or more adjustable neck lengths, according to another embodiment of the present disclosure. Acoustic damper 702 is similar in many aspects to the acoustic damper 202 (FIG. 2) and the acoustic damper 502 (FIG. 5). Therefore, similar features in the acoustic damper 702 are not further described. For example, similar to the acoustic damper 202 having the housing 204 (FIG. 2), the acoustic damper 702 has a housing 704. One distinction between the acoustic damper 702 and the acoustic damper 202 is that the acoustic damper 702 is not provided with a piston 206 (shown in FIG. 2) or the bellows 406 (shown in FIG. 4). Instead, the housing 704 includes one or more neck holes 704A that are adjustable in length. In this embodiment, the one or more neck holes are not adjustable in diameter as in the embodiment shown in FIG. 5. In this embodiment, the one or more neck holes 704A are adjustable in length using an expanding device or a contracting device 705 (e.g., a bellows with holes). In another embodiment, the expanding or contracting device 705 can include a porous material which can expand and contract. As a result of the expansion or contraction of the porous material, pores within the porous material can also expand and contract. The expanding or contracting pores can play the role of one or more neck holes 704A being adjustable in length. Therefore, the porous material can be used to vary a length of the one or more neck holes 704A. By varying a length of the neck holes 704A, the damping acoustic frequency of the acoustic damper 702 can be varied as needed to match the acoustic frequency within the combustion chamber 200B.

In this embodiment, the combustor 200 includes a mechanism configured to vary a damping acoustic frequency of the acoustic damper 702 so as to vary the damping acoustic frequency of the acoustic damper 702 to align with an acoustic frequency of acoustic vibrations generated in the combustion chamber 200B to attenuate an acoustic instability within the combustion chamber 200B. In this embodiment, the mechanism includes the expanding or contracting device 705 configured to vary a length of the one or more neck holes neck holes 704A to vary the damping acoustic frequency of the acoustic damper 702. The expanding or the contracting device 705 includes bellows configured to vary the length of the one or more neck holes 704A to vary the damping acoustic frequency of the acoustic damper 702.

Figure 8:
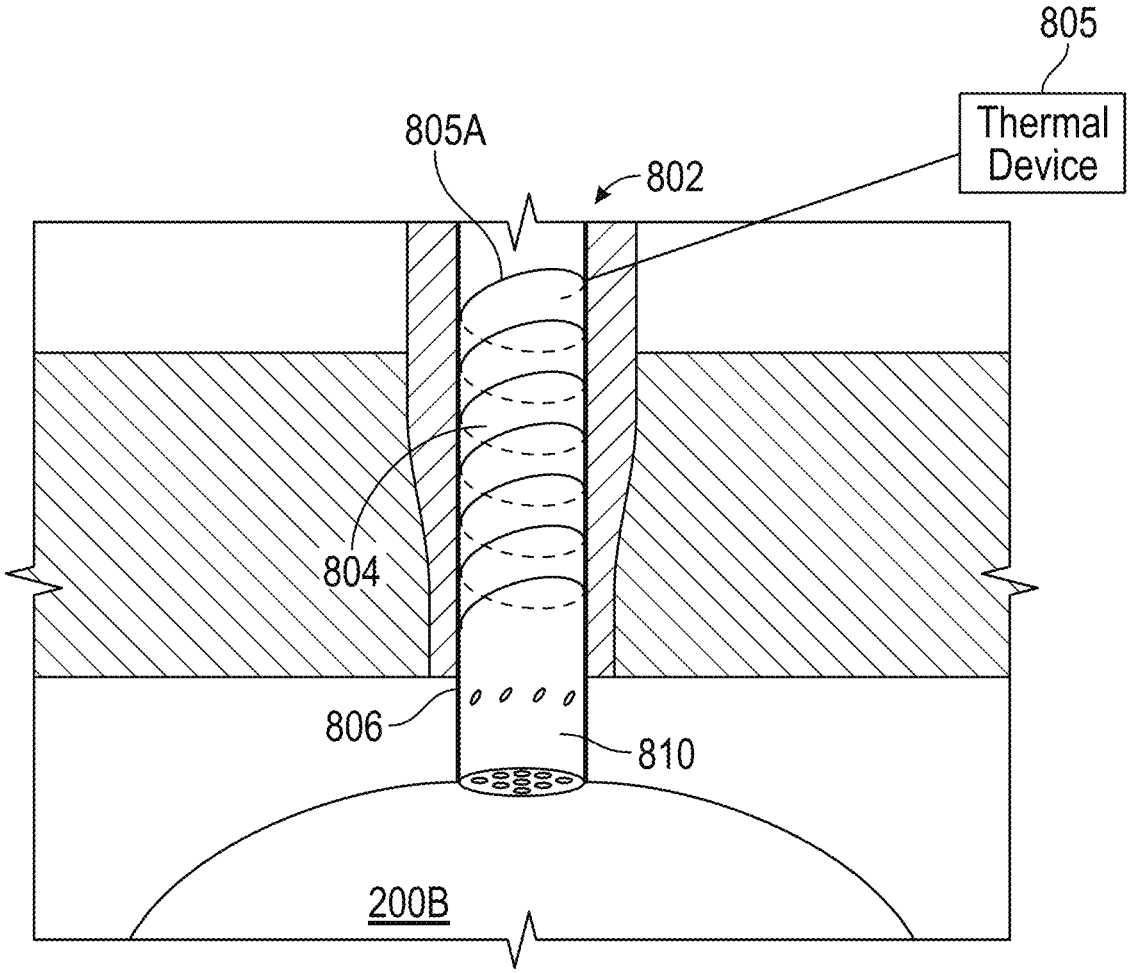
FIG. 8 is a schematic cross-sectional view of an acoustic damper in a combustor of a turbine engine, the acoustic damper having a thermal device, according to another embodiment of the present disclosure.

FIG. 8 is a schematic cross-sectional view of an acoustic damper in a combustor of a turbine engine, the acoustic damper having a thermal device, according to another embodiment of the present disclosure. Acoustic damper 802 is similar in many aspects to the acoustic damper 202 (FIG. 2), the acoustic damper 502 (FIG. 5), and the acoustic damper 702 (FIG. 7). Therefore, similar features in the acoustic damper 802 are not further described. For example, similar to the acoustic damper 202 having the housing 204 (FIG. 2), the acoustic damper 802 has a housing 804. One distinction between the acoustic damper 802 and the acoustic damper 202 is that the acoustic damper 802 is not provided with a piston 206 (shown in FIG. 2) or the bellows 406 (shown in FIG. 4). Instead, the housing 804 includes a thermal device 805. In this embodiment, the thermal device 805 can be configured to apply heat or to cool a wall 806 of the housing 804. For example, to apply heat to the wall 806, the thermal device 805 can apply a current to a heating wire arranged around the wall 806. For example, to cool the wall 806, the thermal device 805 can circulate a coolant around the wall 806. The thermal device 805 can heat and/or cool the wall 806. For example, the thermal device 805 can include a heating and/or cooling circuit 805A that is wound around an exterior surface of the housing 804. In addition, the heating and/or cooling circuit 805A may also be provided inside the housing 804 to heat and/or to cool the interior of the housing 804 or a cavity 810 within the housing 804 to heat or to cool a gas mixture within the housing 804. By heating and/or cooling the acoustic damper 802 and, thus, heating and/or cooling the gas mixture within the cavity 810 of the housing 804 of the acoustic damper 802, the damping acoustic frequency of the acoustic damper 802 can be varied as needed to match the acoustic frequency with the combustion chamber 200B. Adjusting the temperature of the gas mixture within the housing 804 of the acoustic damper 802 allows adjusting the speed of sound within the housing 804 of the acoustic damper 802 and, thus, the damping acoustic frequency of the acoustic damper 802 can be varied as needed to match the acoustic frequency within the combustion chamber 200B.

In this embodiment, the combustor 200 includes a mechanism configured to vary a damping acoustic frequency of the acoustic damper 802 so as to vary the damping acoustic frequency of the acoustic damper 802 to align with an acoustic frequency of acoustic vibrations generated in the combustion chamber 200B to attenuate an acoustic instability within the combustion chamber 200B. In this embodiment, the mechanism includes the thermal device 805 configured to apply heat or to cool the housing 804 or to apply heat or to cool the cavity 810 of the housing 804, to apply heat or to cool the gas mixture within the cavity 810 of the housing 804 to vary the damping acoustic frequency of the acoustic damper 802.

Figure 9:
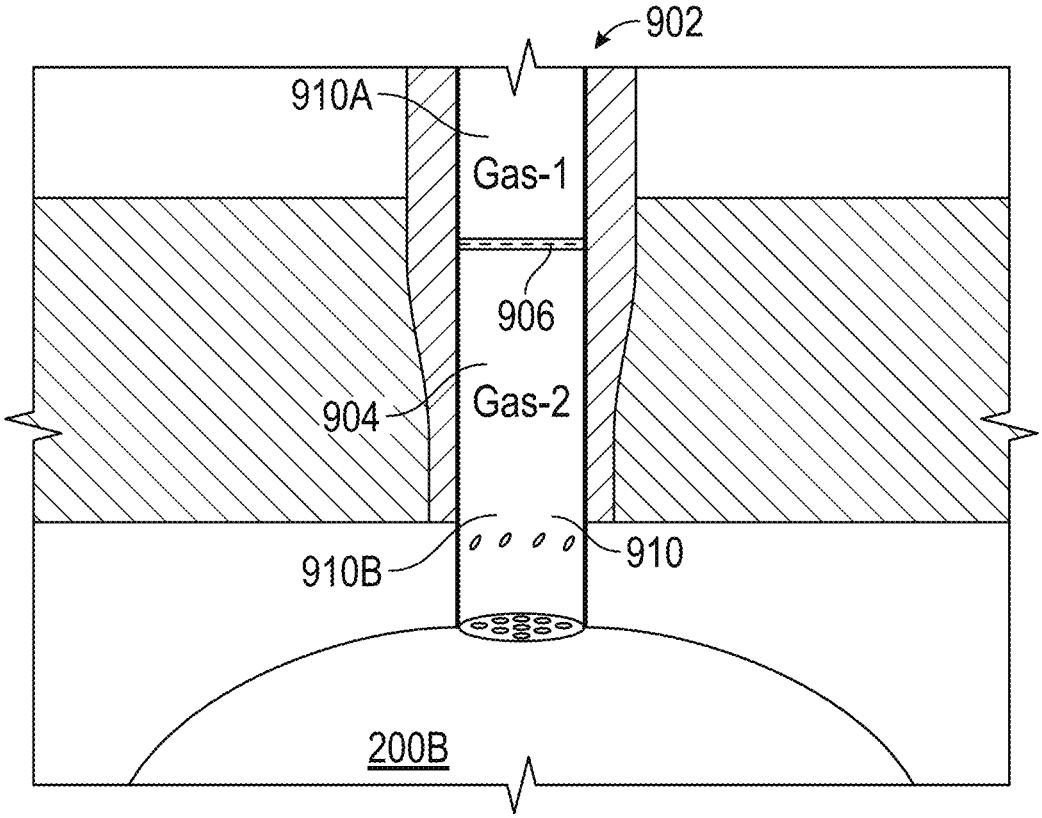
FIG. 9 is a schematic cross-sectional view of an acoustic damper in a combustor of a turbine engine, the acoustic damper having a membrane diving a cavity of the acoustic damper, according to another embodiment of the present disclosure.

FIG. 9 is a schematic cross-sectional view of an acoustic damper in a combustor of a turbine engine, the acoustic damper having a membrane dividing a cavity of the acoustic damper, according to another embodiment of the present disclosure. Acoustic damper 902 is similar in many aspects to the acoustic damper 202 (FIG. 2), the acoustic damper 502 (FIG. 5), the acoustic damper 702 (FIG. 7), and the acoustic damper 802 (FIG. 8). Therefore, similar features in the acoustic damper 902 are not further described. For example, similar to the acoustic damper 202 having the housing 204 (FIG. 2), the acoustic damper 902 has a housing 904. One distinction between the acoustic damper 902 and the acoustic damper 202 is that the acoustic damper 902 is not provided with a piston 206 (shown in FIG. 2) or the bellows 406 (shown in FIG. 4). Instead, the housing 904 includes a dividing membrane 906 configured to divide a cavity 910 within the housing 904 of the acoustic damper into a first cavity portion 910A and a second cavity portion 910B. In an embodiment, the first cavity portion 910A and the second cavity portion 910B can be filled with different gas mixture compositions. In an embodiment, the dividing membrane 906 is impermeable to fluids (e.g., gas), but is substantially transparent to acoustic waves. The gas mixture (Gas-1) within the first cavity portion 910A and the gas mixture (Gas-2) within the second cavity portion 910B are physically separated by the dividing membrane 906. The gas mixture composition (Gas-1) in the first cavity portion 910A or the gas mixture composition (Gas-2) in the second cavity portion 910B can be adjusted to vary a speed of sound within the first cavity portion 910A or within the second cavity portion 910B. Adjusting the gas mixture composition is used herein broadly to mean changing a density or a pressure of the gas mixture composition or changing the chemical composition of the gas mixture composition. As a result, the damping acoustic frequency of the acoustic damper 902 can be varied as needed by varying the gas mixture composition (Gas-1) within the first cavity portion 910A, by adjusting the gas mixture composition (Gas-2) within the second cavity portion 910B, or both, to match the acoustic frequency within the combustion chamber 200B.

In this embodiment, the combustor 200 includes a mechanism configured to vary a damping acoustic frequency of the acoustic damper 902 so as to vary the damping acoustic frequency of the acoustic damper 902 to align with an acoustic frequency of acoustic vibrations generated in the combustion chamber 200B to attenuate an acoustic instability within the combustion chamber 200B. In this embodiment, the mechanism includes the dividing membrane 906 dividing the cavity 910 within the housing 904 into the first cavity portion 910A and the second cavity portion 910B, the first cavity portion 910A and the second cavity portion 910B being filled with different gas mixtures, and the membrane 906 is impermeable to fluids and is substantially transparent to acoustic waves.

Figure 10:
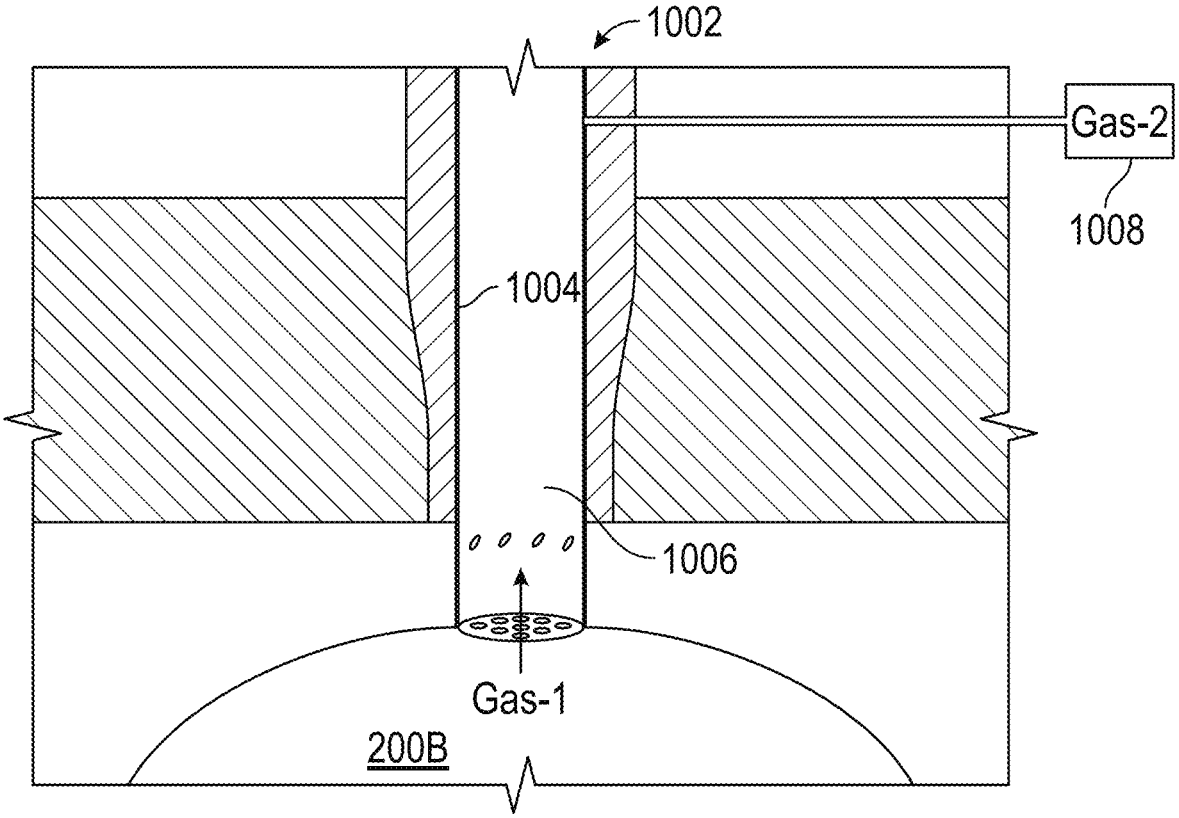
FIG. 10 is a schematic cross-sectional view of an acoustic damper in a combustor of a turbine engine, the acoustic damper having a gas container, according to another embodiment of the present disclosure.

FIG. 10 is a schematic cross-sectional view of an acoustic damper in a combustor of a turbine engine, the acoustic damper having a gas container, according to another embodiment of the present disclosure. Acoustic damper 1002 is similar in many aspects to the acoustic damper 202 (FIG. 2), the acoustic damper 502 (FIG. 5), the acoustic damper 702 (FIG. 7), the acoustic damper 802 (FIG. 8), and the acoustic damper 902 (FIG. 9). Therefore, similar features in the acoustic damper 1002 are not further described. For example, similar to the acoustic damper 202 having the housing 204 (FIG. 2), the acoustic damper 1002 has a housing 1004 defining a cavity 1006. One distinction between the acoustic damper 1002 and the acoustic damper 202 is that the acoustic damper 1002 is not provided with a piston 206 (shown in FIG. 2) or the bellows 406 (shown in FIG. 4). Instead, the acoustic damper 1002 includes a gas container 1008 in fluid communication with the cavity 1006 within the housing 1004 of the acoustic damper 1002. For example, the gas container 1008 can be provided in communication with a distal end of the housing 1004 opposite to a proximal end of the housing 1004 that is in fluid communication with the combustion chamber 200B. For example, the gas container 1008 may contain a gas or a gas mixture (Gas-2) that is different from a gas mixture (Gas-1) within the combustion chamber 200B. In an embodiment, the gas or gas mixture (Gas-2) can be selected or changed to change the speed of sound within the cavity 1006 of the acoustic damper 1002 and thus vary the damping acoustic frequency of the acoustic damper 1002 so as to match or to align with the acoustic frequency within the combustion chamber 200B.

In this embodiment, the combustor 200 includes a mechanism configured to vary a damping acoustic frequency of the acoustic damper 1002 so as to vary the damping acoustic frequency of the acoustic damper 1002 to align with an acoustic frequency of acoustic vibrations generated in the combustion chamber 200B to attenuate an acoustic instability within the combustion chamber 200B. In this embodiment, the mechanism includes the gas container 1008 in fluid communication with the cavity 1006 within the housing 1004, the gas container 1008 containing a gas or gas mixture that is different from a gas mixture within the combustion chamber 200B. The gas or the gas mixture is selected or changed to change a speed of sound to vary the damping acoustic frequency of the acoustic damper 1002 so as to align with the acoustic frequency within the combustion chamber 200B. The gas container 1008 can be provided in communication with a distal end of the housing 1004 opposite to a proximal end of the housing 1004 that is in fluid communication with the combustion chamber 200B.

Further aspects are provided by the subject matter of the following clauses.

A combustor for a turbine engine, the combustor includes a wall defining a combustion chamber, and an acoustic damper including a housing in fluid communication with the combustion chamber through an opening provided in the wall, the housing defining a cavity and having one or more neck holes in fluid communication with the combustion chamber, and a mechanism configured to vary a damping acoustic frequency of the acoustic damper so as to vary the damping acoustic frequency of the acoustic damper to align with an acoustic frequency of acoustic vibrations generated in the combustion chamber to attenuate an acoustic instability within the combustion chamber.

The combustor of the preceding clause further includes a sensor and an actuator, the sensor being configured to measure the acoustic frequency of acoustic vibrations generated in the combustion chamber and to send a measurement signal to a controller in communication with the sensor, the controller being configured to send a control signal, based on the measurement signal, to the actuator in communication with the controller to control the mechanism to vary the damping acoustic frequency of the acoustic damper.

The combustor of any preceding clause, wherein the mechanism includes a piston configured to move within the cavity of the housing to vary a length of the cavity so as to vary the damping acoustic frequency of the acoustic damper.

The combustor of any preceding clause, wherein the mechanism includes a bellows configured to move within the cavity of the housing to vary a length of the cavity so as to vary the damping acoustic frequency of the acoustic damper.

The combustor of any preceding clause, wherein the mechanism includes a thermal device configured to at least one of apply heat to the housing, or to cool the housing, to apply heat to the cavity of the housing, to cool the cavity of the housing. to apply heat to a gas mixture within the cavity of the housing, or to cool the gas mixture within the cavity of the housing, so as to vary the damping acoustic frequency of the acoustic damper.

The combustor of any preceding clause, wherein the mechanism includes an expanding device or a contracting device configured to vary a length of the one or more neck holes to vary the damping acoustic frequency of the acoustic damper.

The combustor of any preceding clause, wherein the expanding device or the contracting device includes bellows configured to vary the length of the one or more neck holes to vary the damping acoustic frequency of the acoustic damper.

The combustor of any preceding clause, wherein the mechanism includes a gas container in fluid communication with the cavity within the housing, the gas container containing a gas or gas mixture that is different from a gas mixture within the combustion chamber, wherein the gas or the gas mixture within the gas container is selected or changed to change a speed of sound within the cavity to vary the damping acoustic frequency of the acoustic damper so as to align with the acoustic frequency within the combustion chamber.

The combustor of any preceding clause, wherein the gas container is provided in communication with a distal end of the housing opposite to a proximal end of the housing that is in fluid communication with the combustion chamber.

The combustor of any preceding clause, wherein the mechanism includes one or more shutters configured to vary a dimension of the one or more neck holes to vary the damping acoustic frequency of the acoustic damper.

The combustor of any preceding clause, wherein the one or more shutters are provided on a portion of the one or more neck holes.

The combustor of any preceding clause, wherein the one or more shutters are rotatable shutters, slidable shutters, or iris-type shutters, or any combination thereof.

The combustor of any preceding clause, wherein the mechanism includes a membrane dividing the cavity within the housing into a first cavity portion and a second cavity portion, the first cavity portion and the second cavity portion being filled with different gas mixtures, and the membrane is impermeable to fluids and is substantially transparent to acoustic waves.

The combustor of any preceding clause, wherein a gas mixture composition in the first cavity portion or a gas mixture composition in the second cavity portion, or both, is adjusted to vary a speed of sound within the first cavity portion or within the second cavity portion, or both, to vary the damping acoustic frequency of the acoustic damper.

The combustor of any preceding clause, wherein the gas mixture composition in the first cavity portion or the gas mixture composition in the second cavity portion, or both, is adjusted by adjusting a density or a pressure of the gas mixture composition in the first cavity portion or the gas mixture composition in the second cavity portion, or both.

The combustor of any preceding clause, wherein the gas mixture composition in the first cavity portion or the gas mixture composition in the second cavity portion, or both, is adjusted by changing a chemical composition of the gas mixture composition in the first cavity portion or the gas mixture composition in the second cavity portion, or both.

A turbine engine includes a compressor section, a combustion section downstream of the compressor section, and a turbine section downstream of the combustion section. The combustion section has a combustor including (a) a wall defining a combustion chamber, and (b) an acoustic damper including a housing in fluid communication with the combustion chamber through an opening provided in the wall, the housing defining a cavity and having one or more neck holes in fluid communication with the combustion chamber, and a mechanism configured to vary a damping acoustic frequency of the acoustic damper so as to vary the damping acoustic frequency of the acoustic damper to align with an acoustic frequency of acoustic vibrations generated in the combustion chamber to attenuate an acoustic instability within the combustion chamber.

The turbine engine of the preceding clause, wherein the combustor further includes a sensor and an actuator, the sensor being configured to measure the acoustic frequency of acoustic vibrations generated in the combustion chamber and to send a measurement signal to a controller in communication with the sensor, the controller being configured to send a control signal, based on the measurement signal, to the actuator in communication with the controller to control the mechanism to vary the damping acoustic frequency of the acoustic damper.

The turbine engine of any preceding clause, wherein the mechanism includes a piston configured to move within the cavity of the housing to vary a length of the cavity so as to vary the damping acoustic frequency of the acoustic damper or a bellows configured to move within the cavity of the housing to vary the length of the cavity so as to vary the damping acoustic frequency of the acoustic damper.

The turbine engine of any preceding clause, wherein (a) the mechanism includes one or more shutters configured to vary a dimension of the one or more neck holes to vary the damping acoustic frequency of the acoustic damper, or (b) the mechanism includes an expanding device or a contracting device configured to vary a length of the one or more neck holes to vary the damping acoustic frequency of the acoustic damper, or (c) the mechanism includes a thermal device configured to apply heat to the housing, to cool the housing, or to apply heat to the cavity of the housing, to cool the cavity of the housing, to apply heat to a gas mixture within the cavity of the housing, or to cool a gas mixture within the cavity of the housing, so as to vary the damping acoustic frequency of the acoustic damper, or (d) the mechanism includes a membrane dividing the cavity within the housing into a first cavity portion and a second cavity portion, the first cavity portion and the second cavity portion are filled with different gas mixtures, and the membrane being impermeable to fluids and being substantially transparent to acoustic waves, or (e) the mechanism includes a gas container in fluid communication with the cavity within the housing, the gas container containing a gas or a gas mixture that is different from a gas mixture within the combustion chamber, the gas or the gas mixture within the gas container being selected or changed to change a speed of sound within the cavity to vary the damping acoustic frequency of the acoustic damper so as to align with the acoustic frequency within the combustion chamber, or the gas container is provided in communication with a distal end of the housing opposite to a proximal end of the housing that is in fluid communication with the combustion chamber.

A turbine engine includes a compressor section, a combustion section downstream of the compressor section, and a turbine section downstream of the combustion section. The combustion section has a combustor including a wall defining a combustion chamber; and an acoustic damper. The acoustic damper includes a housing in fluid communication with the combustion chamber through an opening provided in the wall, the housing defining a cavity and having one or more neck holes in fluid communication with the combustion chamber, and a mechanism configured to vary a damping acoustic frequency of the acoustic damper so as to vary the damping acoustic frequency of the acoustic damper to align with an acoustic frequency of acoustic vibrations generated in the combustion chamber to attenuate an acoustic instability within the combustion chamber.

The turbine engine of the preceding clause, wherein the acoustic damper includes a sensor and an actuator, the sensor being configured to measure the acoustic frequency of acoustic vibrations generated in the combustion chamber and to send a measurement signal to a controller in communication with the sensor, the controller being configured to send a control signal, based on the measurement signal, to the actuator in communication with the controller to control the mechanism to vary the damping acoustic frequency of the acoustic damper.

The turbine engine of any preceding clause, wherein the mechanism includes a piston configured to move within the cavity of the housing to vary a length of the cavity so as to vary the damping acoustic frequency of the acoustic damper.

The turbine engine of any preceding clause, wherein the mechanism includes a bellows configured to move within the cavity of the housing to vary a length of the cavity so as to vary the damping acoustic frequency of the acoustic damper.

The turbine engine of any preceding clause, wherein the mechanism includes a thermal device configured to apply heat or to cool the housing or to apply heat or to cool the cavity of the housing to apply heat or to cool a gas mixture within the cavity of the housing to vary the damping acoustic frequency of the acoustic damper.

The turbine engine of any preceding clause, wherein the mechanism includes an expanding or contracting device configured to vary a length of the one or more neck holes to vary the damping acoustic frequency of the acoustic damper.

The turbine engine of any preceding clause, wherein the expanding or the contracting device includes bellows configured to vary the length of the one or more neck holes to vary the damping acoustic frequency of the acoustic damper.

The turbine engine of any preceding clause, wherein the mechanism includes a gas container in fluid communication with the cavity within the housing, the gas container containing a gas or gas mixture that is different from a gas mixture within the combustion chamber, wherein the gas or the gas mixture is selected or changed to change a speed of sound to vary the damping acoustic frequency of the acoustic damper so as to align with the acoustic frequency within the combustion chamber.

The turbine engine of any preceding clause, wherein the gas container is provided in communication with a distal end of the housing opposite to a proximal end of the housing that is in fluid communication with the combustion chamber.

The turbine engine of any preceding clause, wherein the mechanism includes one or more shutters configured to vary a dimension of the one or more neck holes to vary the damping acoustic frequency of the acoustic damper.

The turbine engine of any preceding clause, wherein the one or more shutters are provided on a portion of the one or more neck holes.

The turbine engine of any preceding clause, wherein the one or more shutters are rotatable shutters, slidable shutters, or iris-type shutters, or any combination thereof.

The turbine engine of any preceding clause, wherein the mechanism includes a membrane dividing the cavity within the housing into a first cavity portion and a second cavity portion, the first cavity portion and the second cavity portion being filled with different gas mixtures, and the membrane is impermeable to fluids and is substantially transparent to acoustic waves.

The turbine engine of any preceding clause, wherein a gas mixture composition in the first cavity portion or a gas mixture composition in the second cavity portion, or both, is adjusted to vary a speed of sound within the first cavity portion or within the second cavity portion, or both, to vary the damping acoustic frequency of the acoustic damper.

The turbine engine of any preceding clause, wherein the gas mixture composition in the first cavity portion or the gas mixture composition in the second cavity portion, or both, is adjusted by adjusting a density or a pressure of the gas mixture composition in the first cavity portion or the gas mixture composition in the second cavity portion, or both.

The turbine engine of any preceding clause, wherein the gas mixture composition in the first cavity portion or the gas mixture composition in the second cavity portion, or both, is adjusted by changing a chemical composition of the gas mixture composition in the first cavity portion or the gas mixture composition in the second cavity portion, or both.

Although the foregoing description is directed to the preferred embodiments of the present disclosure, other variations and modifications will be apparent to those skilled in the art and may be made without departing from the disclosure. Moreover, features described in connection with one embodiment of the present disclosure may be used in conjunction with other embodiments, even if not explicitly stated above.

The invention claimed is:

1. A combustor for a turbine engine, the combustor comprising:

a wall defining a combustion chamber; and an acoustic damper comprising:

a housing in fluid communication with the combustion chamber through an opening provided in the wall of the combustion chamber, the housing mounted to the combustor via an armature, the housing defining a cavity and having a lateral wall, one or more neck holes in fluid communication with the combustion chamber, and one or more purge holes provided within the lateral wall of the housing, the one or more neck holes being provided on a face plate of the housing facing the combustion chamber; and a mechanism configured to vary a damping acoustic frequency of the acoustic damper via a piston moving through the armature to align with an acoustic frequency of acoustic vibrations generated in the combustion chamber to attenuate an acoustic instability within the combustion chamber and the one or more purge holes are provided between the armature and the face plate.

2. The combustor of claim 1, further comprising a sensor and an actuator, the sensor configured to measure the acoustic frequency of the acoustic vibrations generated in the combustion chamber and to send a measurement signal to a controller in communication with the sensor, the controller configured to send a control signal, based on the measurement signal, to the actuator in communication with the controller to control the mechanism to vary the damping acoustic frequency of the acoustic damper.

3. The combustor of claim 1, wherein the piston is configured to move within the cavity of the housing to vary a length of the cavity so as to vary the damping acoustic frequency of the acoustic damper.

4. A turbine engine comprising:

a compressor section, a combustion section downstream of the compressor section, and a turbine section downstream of the combustion section, the combustion section having a combustor comprising:

a wall defining a combustion chamber; and an acoustic damper comprising:

a housing in fluid communication with the combustion chamber through an opening provided in the wall of the combustion chamber, the housing mounted to the combustor via an armature, the housing defining a cavity and having a lateral wall, one or more neck holes in fluid communication with the combustion chamber, and one or more purge holes provided within the lateral wall of the housing, the one or more neck holes being provided on a face plate of the housing facing the combustion chamber; and a mechanism configured to vary a damping acoustic frequency of the acoustic damper via a piston moving through the armature to align with an acoustic frequency of acoustic vibrations generated in the combustion chamber to attenuate an acoustic instability within the combustion chamber and the one or more purge holes are provided between the armature and the face plate.

5. The turbine engine of claim 4, wherein the combustor further comprises a sensor and an actuator, the sensor configured to measure the acoustic frequency of the acoustic vibrations generated in the combustion chamber and to send a measurement signal to a controller in communication with the sensor, the controller configured to send a control signal, based on the measurement signal, to the actuator in communication with the controller to control the mechanism to vary the damping acoustic frequency of the acoustic damper.

6. The turbine engine of claim 4, wherein the piston is configured to move within the cavity of the housing to vary a length of the cavity so as to vary the damping acoustic frequency of the acoustic damper or a bellows configured to move within the cavity of the housing to vary the length of the cavity so as to vary the damping acoustic frequency of the acoustic damper.

* * * * *